United States Patent [19]

Miller

[11] 4,366,104

[45] Dec. 28, 1982

[54] FUEL FEED SYSTEM FOR INTERNAL COMBUSTION ENGINES

[76] Inventor: Harvey R. Miller, 3655 E. Amazon, Eugene, Oreg. 97405

[21] Appl. No.: 342,351

[22] Filed: Jan. 25, 1982

[51] Int. Cl.[3] ..... F02M 13/06

[52] U.S. Cl. ..... 261/18 A; 261/78 R; 261/DIG. 28; 261/DIG. 39

[58] Field of Search ..... 261/18 A, 16, DIG. 39, 261/78 R; 55/DIG. 28

[56] References Cited

U.S. PATENT DOCUMENTS

| | | | |
|---|---|---|---|
| 1,948,282 | 3/1934 | Winslow | 55/DIG. 28 |
| 2,407,478 | 9/1946 | Cruzier et al. | 261/18 A |
| 2,983,592 | 5/1961 | Jones | 55/DIG. 28 |
| 3,174,472 | 3/1965 | Balogh | 261/16 |
| 3,975,466 | 8/1976 | Bradshaw | 261/18 A |
| 4,191,134 | 3/1980 | Goodman | 261/18 A |
| 4,208,989 | 6/1980 | Hart | 261/18 A |
| 4,280,968 | 7/1981 | Smeets | 261/16 |

OTHER PUBLICATIONS

Schultz, "Converting Your Car to Propane", Popular Mechanics, Sep. 1979, 4 pgs.

Schultz, "My 30,000 Miles on Propane", Popular Mechanics, Apr. 1980, 2 pgs.

*Primary Examiner*—Tim R. Miles

*Attorney, Agent, or Firm*—Eugene M. Eckelman

[57] ABSTRACT

An atomizer is arranged for support on the mounting post interiorly of the air filter of fuel feed systems of internal combustion engines. A fuel container is provided and a conduit leads from the container to the atomizer. The conduit terminates in a hollow housing arranged to be clamped on top of the cover of the air filter. The atomizer has a Venturi shape to provide agitation of the fuel to assist in atomization and furthermore it has inner and outer walls with the Venturi shape to provide improved atomization of the fuel.

3 Claims, 1 Drawing Figure

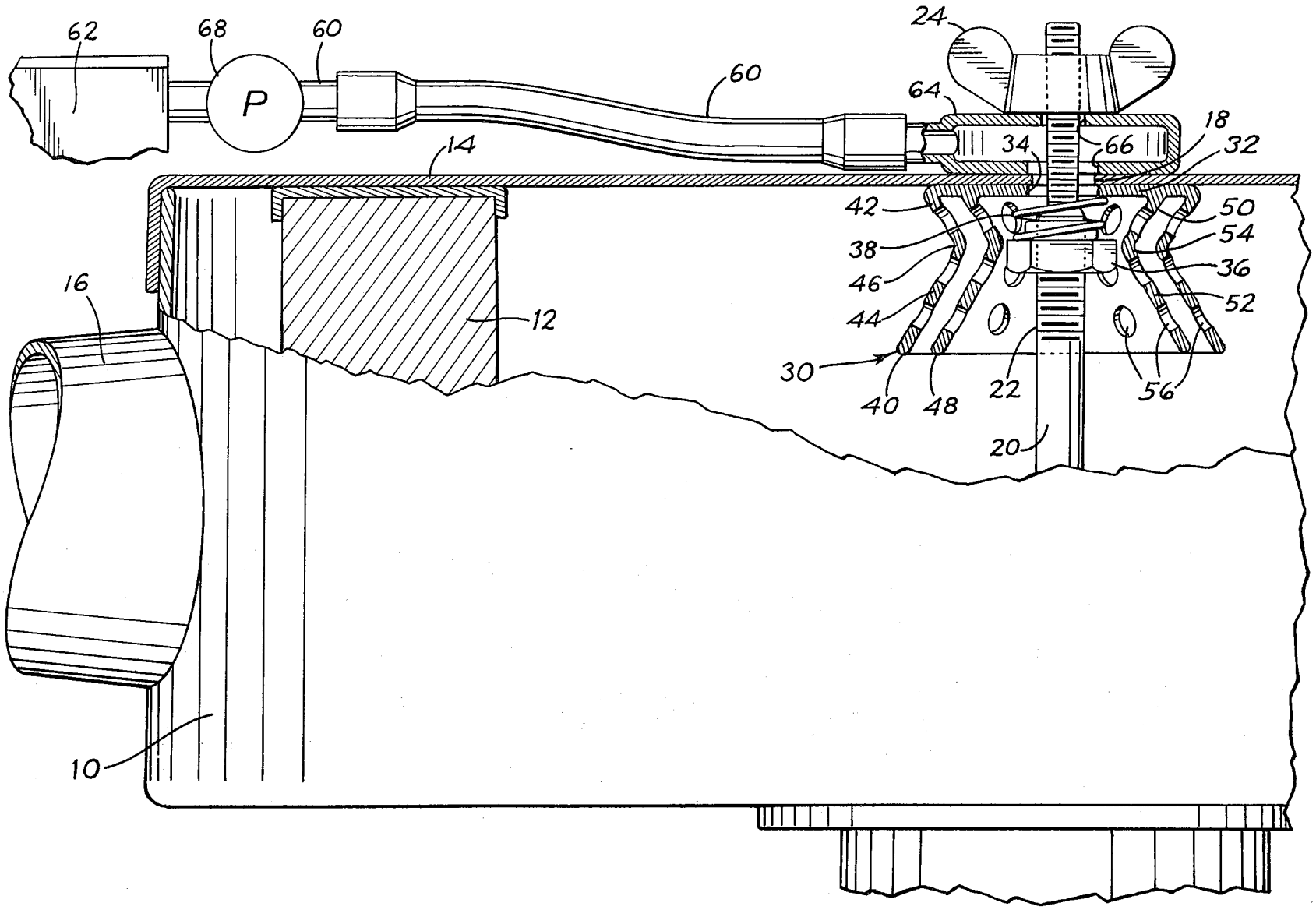
18
32
50
54
36
52
56
66
34
22
20
24
64
48
42
38
46
44
40
30
60
12
14
60
P
68
62
16
10

FUEL FEED SYSTEM FOR INTERNAL COMBUSTION ENGINES

FIELD OF THE INVENTION

This invention relates to new and useful improvements in fuel feed systems arranged for use with internal combustion engines.

SUMMARY OF THE INVENTION

According to the present invention and forming a primary objective thereof, a fuel feed system is provided for internal combustion engines having a novel association with the usual fuel air filter of the engine and arranged to increase mileage per gallon of the vehicle as well as to improve engine operation.

Another object of the invention is to provide a fuel feed system of the type described which is readily adaptable to substantially all makes and types of new and existing vehicles.

In carrying out the objectives of the invention, the fuel system includes a fuel container and atomizing means arranged to be supported on the existing mounting post interiorly of the air filter adjacent the cover of the air filter. Conduit means extend from the container to the atomizing means and terminate in a hollow or fitting arranged to be clamped on top of the cover of the air filter by means of the mounting post of the air filter. The hollow housing and the atomizing means have apertures which receive the mounting post of the air filter and which are enlarged relative to the post whereby fuel from the housing is arranged to flow from the housing through the enlarged apertures in said housing and in said atomizing means and through the aperture in the air filter cover into said atomizing means and thence into the intake system. The body member includes oppositely flared portions forming a Venturi. The body member has a plurality of apertures providing agitation of the fuel to assist in atomization.

The invention will be better understood and additional objects and advantages will become apparent from the following description taken in connection with the accompanying drawings.

BRIEF DESCRIPTION OF THE DRAWINGS

The FIGURE of the drawings is a fragmentary elevational view partly broken away and partly in section showing the fuel feed system of the present invention.

DETAILED DESCRIPTION OF A PREFERRED EMBODIMENT

With particular reference to the drawing, the numeral 10 designates a conventional air filter housing used at the air infeed portion of the fuel system, such as at the carburetor. Housing 10 encloses an annular filter 12 and has a top removable cover 14 and a laterally extending air inlet spout 16. Cover 14 has a central aperture 18 for receiving a mounting post 20 having a threaded portion 22 for receiving a wing nut 24 which is used to clamp the cover 14 removably in place. Post 20 is threadedly mounted at the lower end thereof in a base for the housing 10, not shown, and in conventional structure such post has threaded support in such base. In present practice, the threaded ends 22 of the post are of different diameters to fit different dimensions of threaded bores that now exist on different sizes of automobiles. The aperture 18 in the cover 14 is generally slightly enlarged relative to the threaded portion of the post for easy installation and removal of the cover.

The fuel feed system of the invention includes an atomizer 30 having a top wall 32 with an aperture 34 through which the post 20 extends. Atomizer 30 is held up against the undersurface of the cover of the air filter by a nut 36 engaged with the threads 22 on the post. A compression spring 38 is disposed between the nut and the cover to provide a firm but resilient support for the atomizer 30.

Atomizer 30 is constructed of an outer wall 40 with opposite flared portions 42 and 44 forming a Venturi shape 46. Atomizer 30 also has an inner wall 48 with opposite flared portions 50 and 52 forming a Venturi shape 54. Walls 40 and 48 have a plurality of apertures 56 therein the purpose of which will be described hereinafter.

Fuel to be fed into the fuel system is supplied through a feed tube 60 from a fuel container 62. Feed tube 60 ends in a flat hollow housing or fitting 64 having top and bottom apertures 66 receiving the upper end of the post 20. The lower aperture 66 is enlarged relative to the post to allow free passage of fuel therethrough. Housing 64 is clamped on top of the cover 14 of the filter housing by the wing nut 24. Aperture 34 in the top wall 32 of the atomizer 30 is enlarged relative to the diameter of the post to allow fuel to pass therethrough.

In the operation of the fuel feed of the invention, fuel from the container 62 is drawn in by vacuum of the fuel feed system through feed tube 60. Vacuum of the system is generally sufficient to draw in fuel but a pump 68 may be used if necessary. The fuel is initially dispersed in the housing 64 and from there it passes down through enlarged bottom aperture 66 and then through enlarged apertures 18 and 34 in the cover 14 and atomizer 30 respectively. From there, the fuel is atomized in the double wall tapered atomizer 30. The Venturi shape of atomizer 30 causes the fuel and air mixture to be first compressed at the upper end of the atomizer and then it expands by the Venturi action of such atomizer. The apertures 56 provide agitation for effective atomization.

The fuel feed means of the invention preferably comprises auxiliary fuel feed means, namely, it is used in addition to the conventional fuel feed fuel system. However, the fuel feed of the invention could conceivably comprise the main fuel feed in certain instances. It has been found that the fuel system of the invention provides more complete combustion for better mileage as well as for better engine operation. The system can be used with a gasoline engine with great efficiency in that by supplying a mixture of ethyl alcohol and water from the container 62, preferably in vapor form, a more efficient burning of the main fuel is accomplished. Such not only provides better mileage for the vehicle and better operation but also reduces exhaust emissions.

The fuel feed means of the invention is readily installed on existing automobiles merely by removing the cover 14 of the air filter housing 10, installing a nut 36 and spring 38 as well as the atomizer 30 and then reinstalling the cover 14 and clamping the housing 64 as well as the cover in place by the wing nut 24. The spring 38 holds the atomizer 30 tightly up against the bottom surface of the cover so that incoming fuel must pass through the atomizer.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. A fuel feed system arranged for use with an internal combustion engine of the type having a vacuum operated fuel intake system with an air inlet and an air filter with an interior opening into the intake system, the air filter also including a housing having a cover provided with a central aperture for receiving a mounting post, said fuel feed system comprising (a) an auxiliary fuel container, (b) atomizing means arranged for support on the mounting post interiorly of the air filter adjacent the cover of the air filter, (c) and conduit means extending from said container, (d) said conduit means terminating in a hollow housing arranged to be clamped on top of the cover of the air filter by means of the mounting post of the air filter, (e) said housing and said atomizing means having apertures which receive the mounting post of the air filter and which are enlarged relative to the post whereby fuel from said housing is arranged to flow from said housing through said enlarged apertures in said housing and atomizing means and through the aperture in the air filter cover into said atomizing means and thence into the intake system.

2. The fuel feed system of claim 1 wherein said atomizing means includes a body member having oppositely flared portions forming a Venturi, said flared portions having a plurality of apertures therein providing agitation of the fuel to assist in atomization.

3. The fuel feed system of claim 1 wherein said atomizing means includes a body member having inner and outer walls with oppositely flared portions forming Venturis, said flared portions having a plurality of apertures therein providing agitation of the fuel to assist in atomization.

* * * * *